US010341753B2

(12) United States Patent
Lee

(10) Patent No.: US 10,341,753 B2
(45) Date of Patent: Jul. 2, 2019

(54) EARRING-TYPE MICROPHONE

(71) Applicant: Seung Chul Lee, Daegu (KR)

(72) Inventor: Seung Chul Lee, Daegu (KR)

( * ) Notice: Subject to any disclaimer, the term of this patent is extended or adjusted under 35 U.S.C. 154(b) by 0 days.

(21) Appl. No.: 15/777,638

(22) PCT Filed: Nov. 8, 2016

(86) PCT No.: PCT/KR2016/012765
§ 371 (c)(1),
(2) Date: May 18, 2018

(87) PCT Pub. No.: WO2017/086640
PCT Pub. Date: May 26, 2017

(65) Prior Publication Data

US 2018/0376230 A1 Dec. 27, 2018

(30) Foreign Application Priority Data

Nov. 20, 2015 (KR) ..... 10-2015-0162903

(51) Int. Cl.
*H04R 1/08* (2006.01)
*H04R 1/10* (2006.01)

(52) U.S. Cl.
CPC ..... *H04R 1/08* (2013.01); *H04R 1/10* (2013.01); *H04R 1/105* (2013.01); *H04R 1/1016* (2013.01); *H04R 1/1033* (2013.01)

(58) Field of Classification Search
CPC ..... H04R 1/08; H04R 1/1016; H04R 1/1033; H04R 1/105
USPC ..... 381/375
See application file for complete search history.

(56) References Cited

U.S. PATENT DOCUMENTS 3,548,118 A * 12/1970 Hutchings ..... H04M 1/05 379/430
7,139,405 B1 11/2006 Grattan et al.
2005/0008184 A1* 1/2005 Ito ..... H04M 1/05 381/370
2009/0175480 A1* 7/2009 Zhou ..... H04R 1/1058 381/375
2009/0176538 A1* 7/2009 Dunn ..... H04M 1/6066 455/569.1

(Continued)

FOREIGN PATENT DOCUMENTS

JP 2013-239825 11/2013
KR 10-2002-0066165 A 8/2002

(Continued)

*Primary Examiner* — Sean H Nguyen
(74) *Attorney, Agent, or Firm* — Maschoff Brennan

(57) ABSTRACT

An earring-type microphone to be hung on and used in the ear includes fixing members to be fixed to both ears of a user and a cable formed from an elastic member, of which both ends are respectively positioned at two fixing members, such that one side of the cable comes into close contact with the neck of the user. Speakers are respectively coupled to ends of the cable. A microphone part is provided at one side of the cable for inputting a voice. If force is applied to the microphone part when the user inputs the voice, the cable is stretched such that the microphone part moves from the neck of the user toward the area around the mouth. If the force applied to the microphone part is removed, the microphone part comes into close contact with the area around the mouth by the elastic force of the cable.

13 Claims, 4 Drawing Sheets

(56) References Cited

U.S. PATENT DOCUMENTS

2014/0120983 A1* 5/2014 Lam ..... H04W 84/18
455/557

FOREIGN PATENT DOCUMENTS

KR 10-2008-0075700 A 8/2008
KR 10-2010-0021199 A 2/2010

* cited by examiner

[FIG. 1]
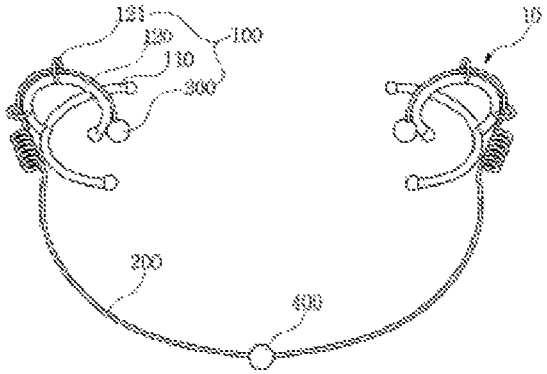
[FIG. 2]
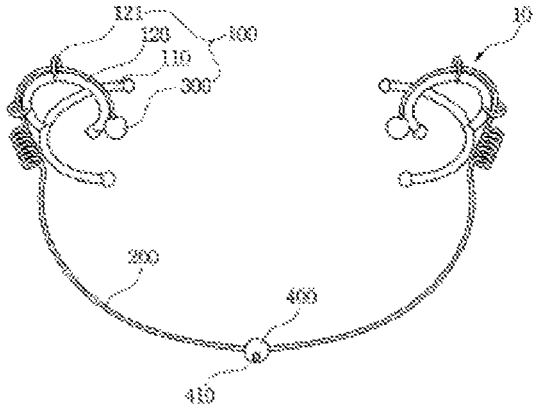
[FIG. 3]
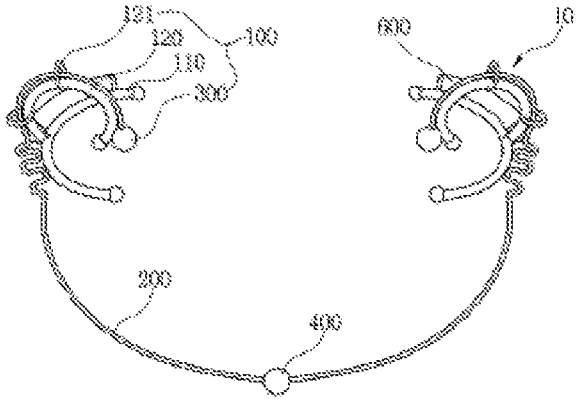

[FIG. 4]
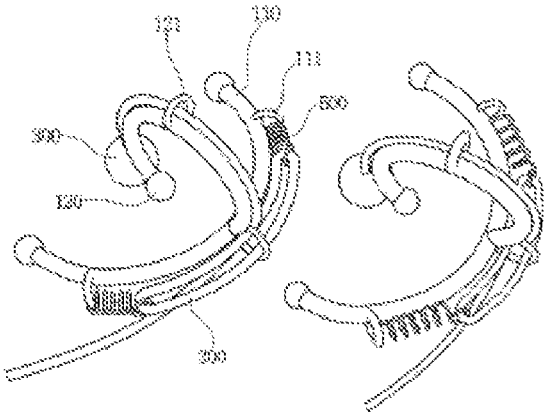
[FIG. 5]
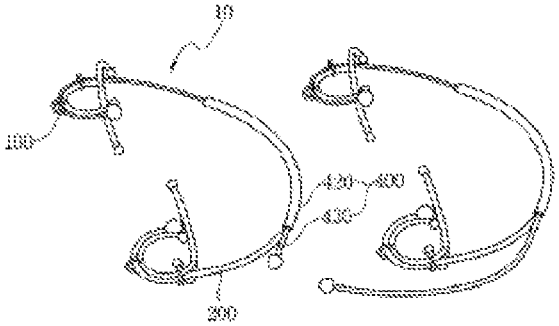
[FIG. 6]
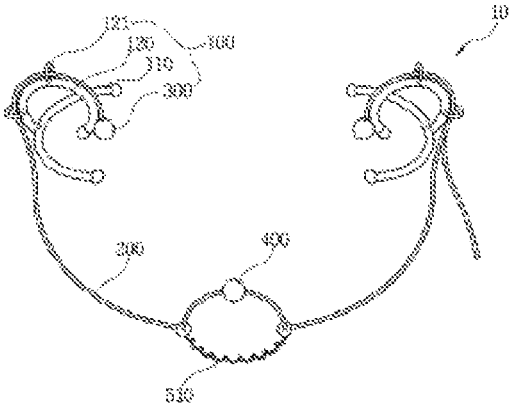

[FIG. 7]
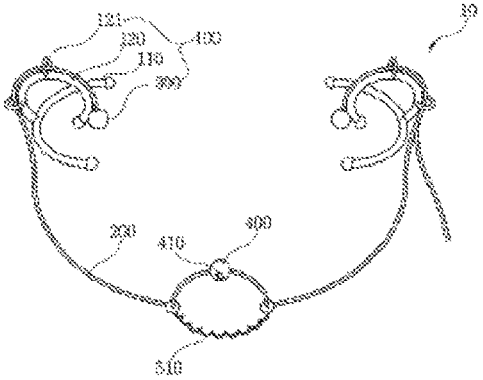
[FIG. 8]
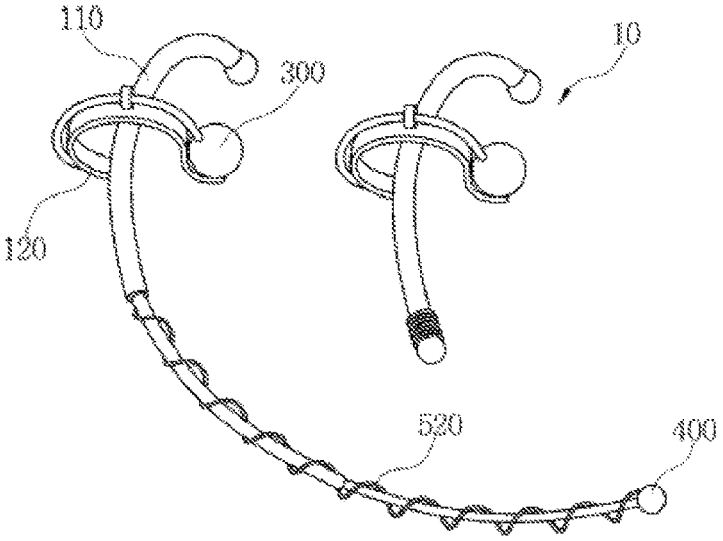
[FIG. 9]
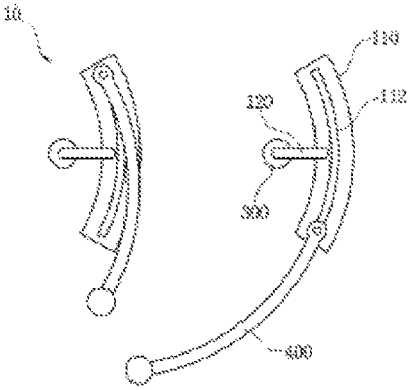

[FIG. 10]
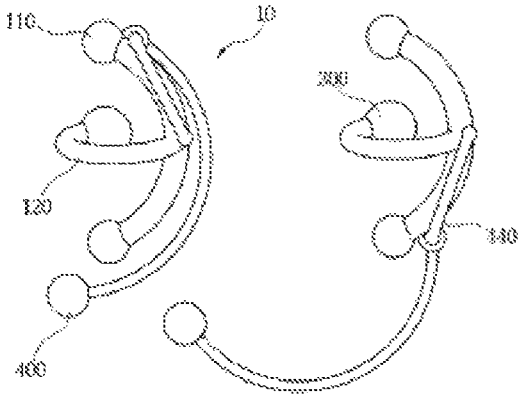

EARRING-TYPE MICROPHONE

TECHNICAL FIELD

The present invention relates to an earring-type microphone which is hung on a user's pinna so as to be easily used.

RELATED ART

Recently, earphones are widely used for smartphones or mobile audio devices. In particular, smartphones as terminals for communications may selectively function as audio devices or communication devices. When smartphones function as communication devices, a microphone integrally combined with earphones (Ear Mic) is generally needed.

Meanwhile, a microphone is connected to a smartphone or a mobile audio device so as to be used. In the event that the connecting part of the microphone is long, when the microphone is kept, it is likely that the long connecting part is twisted or tangled, ruining its appearance, or that a part of the connecting part is folded and bent. Finally, the electric cable is broken or damaged thereby causing malfunction of the microphone.

As a means to partially solve the above-described problems, Korean Patent Application No. 10-2001-0053019 (Aug. 30, 2001) discloses a headset which is also used for a mobile phone. However, when it comes to this related art, when the microphone is pulled from the microphone stand, the microphone is positioned relatively far from the user's mouth thereby inputting surrounding noise.

PRIOR ART DOCUMENT

Patent Document (Patent Document 1) Korean Patent Application No. 10-2001-0053019

DETAILED DESCRIPTION OF THE INVENTION

Technical Problems

As a means to solve the above-described problems with related arts, the present invention provides an earring-type microphone which is simply fixed to a user's ear so as to increase the user's activeness, and easily positioned near the user's mouth when being used such that the user may easily use the microphone. Further, the appearance of the microphone is improved thereby increasing consumer preferences.

Technical Solutions

To achieve the above-described purposes, the present invention provides an earring-type microphone, which is hung on a user's ear so as to be used, including fixing members fixed to both ears of a user, a cable which is manufactured from an elastic member and whose both ends are respectively positioned at the two fixing members such that one side of the cable comes into close contact with the neck of the user, speakers 300 respectively coupled to both ends of the cable, and a microphone part installed at one side of the cable for inputting voice, wherein when the user applies force to the microphone part at the time of inputting the voice through the microphone part, the cable is stretched such that the microphone part moves from the user's neck toward the area around the user's mouth, and if the force applied to the microphone part is removed, the microphone part comes into close contact with the area around the user's mouth by means of the elastic force of the cable.

Another present invention provides an earring-type microphone, which is hung on a user's ear so as to be used, including fixing members fixed to both ears of a user, a cable configured to be a member whose both ends are respectively positioned at and fixed to the two fixing members such that one side of the cable comes into close contact with the front of the user's jaw, a second elastic body whose both ends are configured to be placed a certain distance apart from each other at one side of the cable so as to be respectively connected to the cable, wherein the second elastic body comes into close contact with the user's inner jaw when the cable comes into close contact with the user's front jaw, speakers respectively coupled to both ends of the cable, and a microphone part installed at one side of the cable for inputting voice, wherein the user's jaw is inserted into a hole formed by the cable and the second elastic body such that the cable comes into close contact with the user's front jaw and is prevented from moving by means of the elasticity of the second elastic body when the user moves the jaw.

Yet another present invention provides an earring-type microphone, which is hung on a user's ear so as to be used, including a fixing member fixed to one ear of a user, a cable positioned at and fixed to the fixing member, a speaker coupled to one end of the cable and a microphone part whose one end is coupled to the fixing member so as to be connected to the cable and whose other end is drawn by means of external force so as to input the user's voice, wherein when the user applies force to the microphone part at the time of inputting the voice through the microphone part, the microphone part moves toward the area around the user's mouth.

Advantageous Effects

The advantageous effects of the present invention with the above-described configuration are as follows.

First, the present invention is fixed to a part of the user's body during normal activities so as to increase the activeness of the user. That is, according to the present invention, both ends of the fixing members mesh with the user's ears such that the microphone does not escape from the user's ears compared to conventional microphones while the user is wearing the microphone during various kinds of activities. Further, the fixing members are fixed to the user's ears when being simply opened and closed such that the microphone is easily attached and detached.

Secondly, according to the present invention, when the user uses the microphone, the microphone is easily positioned near the user's mouth so as to input clear sound sources without inputting surrounding noise, and if weight applied on the microphone is removed, the microphone returns to the initial position such that the user may act freely.

BRIEF DESCRIPTION OF THE INVENTION

FIG. 1 is a view illustrating an earring-type microphone according to an embodiment of the present invention.

FIG. 2 is a view illustrating an operation button at the microphone part in FIG. 1

FIG. 3 is a view illustrating main bodies coupled to the first fixing members in FIG. 1.

FIG. 4 is a view illustrating first elastic bodies coupled to the first fixing members in FIG. 1.

FIG. 5 is a view illustrating an earring-type microphone according to the second embodiment of the present invention.

FIG. 6 is a view illustrating an earring-type microphone according to the third embodiment of the present invention.

FIG. 7 is a view illustrating an operation button at the microphone part in FIG. 6.

FIG. 8 is a view illustrating an earring-type microphone according to the fourth embodiment of the present invention.

FIG. 9 is a view illustrating long holes formed at the first fixing members in FIG. 8.

FIG. 10 is a view illustrating an earring-type microphone according to the fifth embodiment of the present invention.

MODE FOR CARRYING OUT THE INVENTION

An earring-type microphone according to the present invention will be described in detail with reference to the attached drawings.

Recently, earphones are widely used for smartphones or mobile audio devices. In particular, smartphones as terminals for communications may selectively function as audio devices or communication devices. When smartphones function as communication devices, a microphone integrally combined with earphones (Ear Mic) is generally needed.

Meanwhile, a microphone is connected to a smartphone or a mobile audio device so as to be used. In the event that the connecting part of the microphone is long, when the microphone is kept, it is likely that the long connecting part is twisted or tangled, ruining its appearance, or that a part of the connecting part is folded and bent. Finally, the electric cable is broken or damaged thereby causing malfunction of the microphone.

As a means to partially solve the above-described problems, Korean Patent Application No. 10-2001-0053019 (Aug. 30, 2001) discloses a headset which is also used for a mobile phone. However, when it comes to this related art, when the microphone is pulled from the microphone stand, the microphone is positioned relatively far from the user's mouth thereby inputting surrounding noise.

As a means to solve the above-described problems with related arts, the present invention provides an earring-type microphone which is simply fixed to a user's ear so as to increase the user's activeness and easily positioned near the user's mouth when being used such that the user may easily use the microphone. Further, the appearance of the microphone is improved thereby increasing consumer preferences.

The present invention is fixed to a part of the user's body during normal activities so as to increase the activeness of the user. That is, according to the present invention, both ends of the fixing members mesh with the user's ears such that the microphone does not escape from the user's ears compared to conventional microphones while the user is wearing the microphone during various kinds of activities. Further, the fixing members are fixed to the user's ears when being simply opened and closed such that the microphone is easily attached and detached. Additionally, according to the present invention, when the user uses the microphone, the microphone is easily positioned near the user's mouth so as to input clear sound sources without inputting surrounding noise, and if weight applied on the microphone is removed, the microphone returns to the initial position such that the user may act freely.

FIG. 1 is a view illustrating an earring-type microphone according to an embodiment of the present invention, and FIG. 2 is a view illustrating an operation button at the microphone part in FIG. 1.

FIG. 3 is a view illustrating main bodies coupled to the first fixing members in FIG. 1, and FIG. 4 is a view illustrating first elastic bodies coupled to the first fixing members in FIG. 1.

FIG. 5 is a view illustrating an earring-type microphone according to the second embodiment of the present invention.

To achieve the above-described purposes, the present invention provides an earring-type microphone 10, which is hung on a user's ear so as to be used, including fixing members 100 fixed to both ears of a user, a cable 200 which is manufactured from an elastic member and whose both ends are respectively positioned at the two fixing members 100 such that one side of the cable comes into close contact with the neck of the user, speakers 300 respectively coupled to both ends of the cable 200, and a microphone part 400 installed at one side of the cable 200 for inputting voice, wherein when the user applies force to the microphone part 400 at the time of inputting the voice through the microphone part 400, the cable is stretched such that the microphone part 400 moves from the user's neck toward the area around the user's mouth, and if the force applied to the microphone part 400 is removed, the microphone part 400 comes into close contact with the area around the user's mouth by means of the elastic force of the cable 200.

The present invention includes fixing members 100, a cable 200, speakers 300 and a microphone part 400, and the present invention relates to an earring-type microphone 10 which is easily coupled to the user's ears to increase the activeness of the user is and also capable of inputting clear sound sources without inputting surrounding noise by means of the microphone part 400 easily positioned around the user's mouth.

The fixing members 100 are members configured to be fixed to both ears of the user. That is, the fixing members 100 are members for allowing the microphone 10 to be easily fixed to the ears of the user.

In the event that the microphone 10 can be easily fixed to the ears of the user, the fixing members 100 may be manufactured in various forms. For instance, the fixing members 100 may consist of first fixing members 110 and second fixing members 120.

The first fixing members 110 are members configured to have a "C" shape so as to come into close contact with the rears of the user's pinnae. The second fixing members 120 are members configured to have a "C" shaper such that one end of the second fixing member 120 is coupled to one side of the first fixing member 110. Accordingly, one end of the second fixing member 120 contacts the outside of the user's ear, and the other end contacts the inside of the user's ear such that both ends of the second fixing member 120 mesh with the user's ear thereby allowing the fixing member 100 to be fixed to the user's ear.

The first fixing member 110 may have first hook members 111 respectively formed at both side of the first fixing member. In the event that the first fixing member 110 has the first hook members 111, first elastic bodies 500 may be formed at the first hook members 111. That is, in the event that the first fixing member 110 has the first hook members 111, the cable 200 is installed in a way that the cable 200 is coupled to the first elastic bodies 500 of the first hook members 111. If force is applied to the microphone part 400, the cable is stretched while the first elastic bodies 500 are relaxed such that the microphone part 400 moves from the user's neck toward the area around the user's mouth, and if the force applied to the microphone part 400 is removed, the microphone part 400 comes into close contact with the area around the user's mouth by means of the elastic force of the first elastic bodies 500. The first elastic bodies 500 may be configured to be a spring or a silicone rubber ring.

The second fixing member 120 may have one or more second hook members 121 along the length direction of the second fixing member 120. The second hook member 121 is configured to allow the cable 200 to penetrate into the second hook member and to come into close contact with the second fixing member 120. Further, a speaker 300 coupled to the cable 200 is caught by the second hook member 121 formed at the other end of the second fixing member 120 such that both ends of the cable 200 are fixed respectively to the other ends of the second fixing members 120.

The fixing members 100 may be manufactured from various materials satisfying the intensity appropriate for the fixing members 100.

The cable 200 is manufactured from an elastic member, both ends of the cable are respectively fixed to the two fixing members 100, and one side of the cable comes into close contact with the user's neck. The cable 200 may be configured to have elasticity at one side of the cable such that the cable stretches if an external force acts on the cable 200 and the cable 200 returns to the initial position thereof if the external force acting on the cable is removed.

In the event that the fixing members 100 consist of the first fixing members 110 and the second fixing members 120, the cable 200 comes into close contact with the second fixing members 120 along the length direction thereof, wherein both ends of the cable 200 may be positioned at the other ends of the second fixing members 120. The cable 200 is positioned at the other ends of the second fixing members 120 because the speakers 300 at both ends of the cable 200 are coupled to the other ends of the second fixing members so as to be positioned at the other ends of the second fixing members 120.

The cable 200 has an elastic member inside the cable so as to have a zigzag shape or a spring shape. Accordingly, the cable 200 is stretched while the spring is stretched if force is applied to the microphone part 400, and one side of the cable 200 returns to the initial state thereof by means of the elastic force of the elastic member if the force applied to the microphone part 400 is removed.

In the event that the fixing members 100 have a hollow, both ends of the cable 200 respectively penetrate into the hollow to be connected to the speakers 300, and the cable 200 may be installed in the fixing members 100 such that the other end of the cable may be connected to a device making sounds.

The cable 200 is configured to be a cable commonly used for the microphone 10 and configured to be a member connected to devices such as radio sets, MP3 players, mobile phones etc. to deliver the sounds made by the devices to the speakers 300 such that the user may hear the sounds.

The speakers 300 are members configured to be respectively coupled to both ends of the cable 200. The speakers 300 are devices for making sounds such that the user may hear the sounds delivered through the cable 200 and are commonly used for earphones or the microphone 10. The speakers 300 are coupled to the cable 200 so as to be positioned at the user's auditory pits or at the fixing members 100 depending on the user's needs. That is, the speaker 300 may be positioned at one end of the fixing member 100 such that the user may not only listen to music but also hear surrounding noise while carrying out a variety of jobs in unsafe places and may be positioned at the user's auditory pit such that the user may listen to music in quiet places such as the library without being interrupted by surrounding noise.

The microphone part 400 is installed at one side of the cable 200 and is a member for inputting a voice. The microphone part 400 is connected to the cable 200 to deliver the input voice signals directly to the speakers 300 or to send voice signals to devices such as smartphones etc. connected to the cable 200 when being installed.

Wherein when the user applies force to the microphone part 400 at the time of inputting the voice through the microphone part 400, the cable is stretched such that the microphone part 400 moves from the user's neck toward the area around the user's mouth, and if the force applied to the microphone part 400 is removed, the microphone part 400 comes into close contact with the area around the user's mouth by means of the elastic force of the cable 200.

The microphone part 400 may be configured to further include an operation button 410 at one side of the microphone part 400 to control an operation. When the user inputs the voice through the microphone part 400, the user applies force to the operation button 410 of the microphone part 400 so as to simultaneously operate the microphone part 400 and move the microphone part 400 from the user's neck toward the area around the user's mouth, and if the force applied to the microphone part 400 is removed, the microphone part 400 comes into close contact with the area around the user's mouth by means of the elastic force of the cable 200 such that the user may input the voice.

In this case, the operation button 410 may be a button for turning on and off the microphone or an operation button for controlling the operation of a calling/ending a call button.

The microphone part 400 includes a microphone body 420 and an inputting part 430. When the user inputs the voice, the inputting part 430 may be moved freely by the user so as to provide convenience to the user. The microphone body 420 is a member configured to have a tube shape and is installed at one side of the cable 200. The inputting part 430 for inputting voice has one end thereof, which is coupled to one side of the inside of the microphone body 420, and the other end thereof which is configured to protrude outwards from the microphone body 420. That is, in the state in which the user is wearing the microphone part 400 at the rear of the user's neck, when the user applies force to the inputting part 430 at the time of inputting the voice through the inputting part 430, the inputting part 430 protrudes to a certain length so as to move from the user's neck toward the area around the user's mouth and to come into close contact with the area around the user's mouth.

The present invention further includes a main body 600 configured to be a device for outputting sounds and coupled to one side of the fixing members 100, wherein the main body 600 is connected to the cable 200 so as to output the sounds input by the microphone part 400 or to send sounds played in itself or sound signals from the outside to the speakers 300.

A variety of devices which may output sounds and may be connected to the fixing members 100 can be used as the main body 600. For instance, smartphones, audio devices etc. may be used as the main body.

FIG. 6 is a view illustrating an earring-type microphone according to the third embodiment of the present invention, and FIG. 7 is a view illustrating an operation button at the microphone part in FIG. 6.

To achieve the above-described purposes, another present invention provides an earring-type microphone, which is hung on a user's ear so as to be used, including fixing members 100 fixed to both ears of a user, a cable 200 configured to be a member whose both ends are respectively positioned at and fixed to the two fixing members 100 such that one side of the cable comes into close contact with the front of the user's jaw, a second elastic body 510 whose both ends are configured to be placed a certain distance apart from each other at one side of the cable so as to be respectively connected to the cable 200, wherein the second elastic body 510 comes into close contact with the user's inner jaw when the cable comes into close contact with the user's front jaw, speakers 300 respectively coupled to both ends of the cable 200, and a microphone part 400 installed at one side of the cable 200 for inputting voice, wherein the user's jaw is inserted into a hole formed by the cable 200 and the second elastic body 510 such that the cable 200 comes into close contact with the user's front jaw and is prevented from moving by means of the elasticity of the second elastic body 510 when the user moves the jaw.

The present invention includes fixing members 100, a cable 200, a second elastic body 510, speakers 300 and a microphone part 400, and the present invention relates to an earring-type microphone 10 which is easily coupled to the user's ears to increase the activeness of the user and is also capable of inputting clear sound sources without inputting surrounding noise by means of the microphone part 400 easily positioned around the user's mouth.

The fixing members 100 are members configured to be fixed to both ears of the user. That is, the fixing members 100 are members for allowing the microphone 10 to be easily fixed to the ears of the user.

In the event that the microphone 10 can be easily fixed to the ears of the user, the fixing members 100 may be manufactured in various forms. For instance, the fixing members 100 may consist of first fixing members and second fixing members.

The first fixing members 110 are members configured to have a "C" shape so as to come into close contact with the rears of the user's pinnae. The second fixing members 120 are members configured to have a "C" shape such that one end of the second fixing member 120 is coupled to one side of the first fixing member 110. Accordingly, one end of the second fixing member 120 contacts the outside of the user's ear, and the other end contacts the inside of the user's ear such that both ends of the second fixing member 120 mesh with the user's ear thereby allowing the fixing member 100 to be fixed to the user's ear.

The second fixing member 120 may have one or more second hook members 121 along the length direction of the second fixing member 120. The second hook member 121 is configured to allow the cable 200 to penetrate into the second hook member and to come into close contact with the second fixing member 120. Further, a speaker 300 coupled to the cable 200 is caught by the second hook member 121 formed at the other end of the second fixing member 120 such that both ends of the cable 200 are fixed respectively to the other ends of the second fixing members 120.

The fixing members 100 may be manufactured from various materials satisfying the intensity appropriate for the fixing members 100.

The cable 200 is configured to be a member whose both ends are respectively positioned at and fixed to the two fixing members 100 such that one side of the cable comes into close contact with the front of the user's jaw.

In the event that the fixing members 100 consist of the first fixing members 110 and the second fixing members 120, the cable 200 comes into close contact with the second fixing members 120 along the length direction thereof, wherein both ends of the cable 200 may be positioned at the other ends of the second fixing members 120. The cable 200 is positioned at the other ends of the second fixing members 120 because the speakers 300 at both ends of the cable 200 are coupled to the other ends of the second fixing members so as to be positioned at the other ends of the second fixing members 120.

In the event that the fixing members 100 have a hollow, both ends of the cable 200 respectively penetrate into the hollow to be connected to the speakers 300, and the cable 200 may be installed in the fixing members 100 such that the other end of the cable may be connected to a device making sounds.

The cable 200 is configured to be a cable commonly used for the microphone 10 and configured to be a member connected to devices such as radio sets, MP3 players, mobile phones etc. to deliver the sounds made by the devices to the speakers 300 such that the user may hear the sounds.

The second elastic body 510 is configured to be a member whose both ends are configured to be placed a certain distance apart from each other at one side of the cable so as to be respectively connected to the cable, wherein the second elastic body 510 comes into close contact with the user's inner jaw when the cable 200 comes into close contact with the user's front jaw. The second elastic body 510 is configured to be a member in which the user's jaw is inserted into a hole formed by the cable 200 and the second elastic body 510, such that the second elastic body 510 moves, while the cable 200 comes into close contact with the user's front jaw and is prevented from moving by means of the elasticity of the second elastic body 510, when the user moves the jaw.

Various elastic materials may be used for the second elastic body 510 as long as the cable 200 may come into close contact with the front jaw of the user even when the user's jaw is moved. For instance, a spring or silicone rubber may be used for the second elastic body.

The speakers 300 are members configured to be respectively coupled to both ends of the cable 200. The speakers 300 are devices for making sounds such that the user may hear the sounds delivered through the cable 200 and are commonly used for earphones or the microphone 10. The speakers 300 are coupled to the cable 200 so as to be positioned at the user's auditory pits or at the fixing members 100 depending on the user's needs. That is, the speakers 300 may be positioned at one end of the fixing members 100 such that the user may not only listen to music but also hear surrounding noise while carrying out a variety of jobs in unsafe places and may be positioned at the user's auditory pits such that the user may listen to music in quiet places such as the library without being interrupted by surrounding noise.

The microphone part 400 is installed at one side of the cable 200 and is an element for inputting a voice. The microphone part 400 is installed at the cable in close contact with the user's jaw so as to clearly input the user's voice without inputting surrounding noise. The microphone part 400 is connected to the cable 200 to deliver input voice signals directly to the speakers 300 or to send voice signals to devices such as smartphones etc. connected to the cable 200 when being installed.

The microphone part 400 may be configured to further include an operation button 410 at one side of the microphone part 400 to control an operation. When the user inputs the voice through the microphone part 400, the user applies force to the operation button 410 of the microphone part 400 to operate the microphone part 400, and if the force applied to the operation button 410 of the microphone part 400 is removed, the microphone part 400 may stop operating.

In this case, the operation button 410 may be a button for turning on and off the microphone or an operation button for controlling the operation of a calling/ending a call button.

The present invention further includes a main body 600 configured to be a device for outputting sounds and coupled to one side of the fixing members 100, wherein the main body 600 is connected to the cable 200 so as to output the sounds input by the microphone part 400 or to send sounds played in itself or sound signals from the outside to the speakers 300.

A variety of devices which may output sounds and may be connected to the fixing members 100 can be used as the main body 600. For instance, smartphones, audio devices etc. may be used as the body.

FIG. 8 is a view illustrating an earring-type microphone according to the fourth embodiment of the present invention, and FIG. 9 is a view illustrating a long hole formed at the first fixing member in FIG. 8.

FIG. 10 is a view illustrating an earring-type microphone according to the fifth embodiment of the present invention.

As a means to achieve the above-described purposes, yet another present invention provides an earring-type microphone 10, which is hung on a user's ear so as to be used, including a fixing member 100 fixed to one ear of a user, a cable 200 positioned at and fixed to the fixing member 100, a speaker 300 coupled to one end of the cable 200 and a microphone part 400 whose one end is coupled to the fixing member 100 so as to be connected to the cable 200 and whose other end is drawn by means of external force so as to input the user's voice, wherein when the user applies force to the microphone part 400 at the time of inputting the voice through the microphone part 400, the microphone part 400 moves toward the area around the user's mouth.

The present invention includes fixing members 100, a cable 200, speakers 300 and a microphone part 400, and the present invention relates to an earring-type microphone 10 which is easily coupled to the user's ears to increase the activeness of the user and is also capable of inputting clear sound sources without inputting surrounding noise by means of the microphone part 400 easily positioned around the user's mouth.

The fixing members 100 are members configured to be fixed to one ear of the user. That is, the fixing members 100 are members for allowing the microphone 10 to be easily fixed to the ear of the user.

In the event that the microphone 10 can be easily fixed to the ear of the user, the fixing members 100 may be manufactured in various forms. For instance, the fixing members 100 may consist of first fixing members 110 and second fixing members 120.

The first fixing members 110 are members configured to have a "C" shape so as to come into close contact with the rears of the user's pinnae. The second fixing members 120 are members configured to have a "C" shaper such that one end of the second fixing member 120 is coupled to one side of the first fixing member 110. Accordingly, one end of the second fixing member 120 contacts the outside of the user's ear, and the other end contacts the inside of the user's ear such that both ends of the second fixing member 120 mesh with the user's ear thereby allowing the fixing member 100 to be fixed to the user's ear.

The first fixing member 110 may have a long hole made along the length direction of the first fixing member 110. The microphone part 400 may move along the hole made, and in detail, one end of the microphone part 400 may move along the long hole 112 of the first fixing member 110 when the user applies force to the microphone part 400 at the time of inputting the voice depending on the way that the user uses the earring-type microphone.

The fixing members 100 may be manufactured from various materials satisfying the intensity appropriate for the fixing members 100.

The cable 200 is configured to be a member positioned at and fixed to the fixing member 100.

In the event that the fixing members 100 consist of the first fixing members 110 and the second fixing members 120, the cable 200 comes into close contact with the second fixing members 120 along the length direction thereof. The cable 200 is positioned at the other ends of the second fixing members 120 because the speakers 300 of the cable 200 are coupled to the other ends of the second fixing members so as to be positioned at the other ends of the second fixing members 120.

In the event that the fixing members 100 have a hollow, the cable 200 penetrate into the hollow to be connected to the speakers 300, and the cable 200 may be installed in the fixing members 100 such that the other end of the cable may be connected to a device making sounds.

The cable 200 is configured to be a cable commonly used for the microphone 10 and configured to be a member connected to devices such as radio sets, MP3 players, mobile phones etc. to deliver the sounds made by the devices to the speakers 300 such that the user may hear the sounds.

The speakers 300 are members configured to be coupled to one end of the cable 200. The speakers 300 are devices for making sounds such that the user may hear the sounds delivered through the cable 200 and are commonly used for earphones or the microphone 10. The speakers 300 are coupled to the cable 200 so as to be positioned at the user's auditory pits or at the fixing members 100 depending on the user's needs. That is, the speakers 300 may be positioned at one end of the fixing members 100 such that the user may not only listen to music but also hear surrounding noise while carrying out a variety of jobs in unsafe places and may be positioned at the user's auditory pits such that the user may listen to music in quiet places such as the library without being interrupted by surrounding noise.

The microphone part 400 has one end thereof coupled to the fixing member 100 so as to be connected to the cable 200, and the other end thereof drawn by means of external force so as to input the user's voice. The microphone part 400 is connected to the cable 200 to deliver input voice signals directly to the speakers 300 or to send voice signals to devices such as smartphones etc. connected to the cable 200 when being installed.

In the case of the microphone part 400 whose other end is drawn by means of external force, the microphone 400 may be coupled in various forms to the fixing member 100. For instance, if the first fixing member 100 has a long hole 112, one end of the microphone part 400 may be coupled to the fixing member 100 so as to move along the long hole 112 of the first fixing member 110.

Further, the microphone part 400 may further include a third elastic body 520 whose one end is coupled to the fixing member 100 and the other end is coupled to the other end of the microphone part 400 so as to wrap up the microphone part 400. In the event that the microphone part 400 has the third elastic body 520, when the user inputs the voice through the microphone part 400, the user may apply force to the microphone part 400 so as to move the microphone part 400 toward the area around the user's mouth, and if the force applied to the microphone part 400 is removed, the microphone part 400 may return to the initial state by means of the elastic force of the third elastic body 520.

The present invention may further include a connecting member 440 whose one end is rotatably coupled to one side of the first fixing member 110, and a microphone part 400 whose one end is coupled to the connecting member 440 for inputting voice. When the user applies force to the microphone part 400 at the time of inputting the voice through the microphone part 400, the connecting member 440 may be rotated such that the microphone part 400 is positioned at wanted places. That is, the connecting member 440 is rotated such that the microphone part 400 is positioned near the user's mouth.

The present invention further includes a main body 600 configured to be a device for outputting sounds and coupled to one side of the fixing members 100, wherein the main body 600 is connected to the cable 200 so as to output the sounds input by the microphone part 400 or to send sounds played in itself or sound signals from the outside to the speakers 300.

A variety of devices which may output sounds and may be connected to the fixing members 100 can be used as the main body 600. For instance, smartphones, audio devices etc. may be used as the main body.

An earring-type microphone according to the present invention has been described in relation to its preferred embodiments. However, the embodiments have been provided as at least one example. Accordingly, the technical ideas, the configurations and the operations of the present invention should not be construed as being limited to the embodiments set forth herein, and the scope of the technical ideas of the present invention should not be construed as being limited to and determined by the attached drawings or the descriptions provided with reference to the attached drawings. Further, that those skilled in the art to which the present invention pertains might use the concept and embodiments suggested by the present invention as the basis for designing and modifying the present invention in various different forms and for achieving the same purposes as those of the present invention. Equivalents of the invention modified or changed by those skilled in the art to which the present invention pertains should be construed as being included in the technical scope of the present invention described in the appended claims, and various changes, replacements and modifications may be made within the spirit and scope of the present invention described in the appended claims.

DESCRIPTION OF THE SYMBOLS

10: Microphone
100: Fixing member
110: First fixing member
111: First hook member
120: Second fixing member
121: Second hook member
200: Cable
300: Speaker
400: Microphone part
410: Operation button
420: Microphone body
430: Inputting part
440: Connecting member
500: First elastic body
510: Second elastic body
520: Third elastic body
600: Main body

The invention claimed is:

1. An earring-type microphone, which is hung on a user's ear so as to be used, the earring-type microphone comprising:

two fixing members respectively fixed to both ears of a user;

a cable configured to be an elastic member and connecting the two fixing members such that a part of the cable comes into close contact with the user's neck;

speakers respectively coupled to both ends of the cable; and a microphone part installed at one side of the cable for inputting voice, wherein when the user applies force to the microphone part at the time of inputting voice through the microphone part, the cable is stretched such that the microphone part moves from the user's neck toward the area around the user's mouth, and if the force applied to the microphone part is removed, the microphone part comes into close contact with the area around the user's mouth by means of the elastic force of the cable.

2. The earring-type microphone according to claim 1, wherein the cable has an elastic member inside the cable such that one side of the cable has a zigzag shape or a spring shape, the cable is stretched while the spring is stretched if force is applied to the microphone part, and one side of the cable returns to the initial state thereof by means of the elastic force of the elastic member if the force applied to the microphone part is removed.

3. The earring-type microphone according to claim 1, the fixing members comprising: first fixing members configured to have a "C" shape so as to come into close contact with rear sides of the user's pinnae; and second fixing members configured to have a "C" shape such that one end of the second fixing member is coupled to one side of the first fixing member, wherein: one end of the second fixing member contacts the outside of the user's ear, and the other end contacts the inside of the user's ear such that both ends of the second fixing member mesh with the user's ear thereby allowing the fixing member to be fixed to the user's ear, and the cable comes into close contact with the second fixing member along the length direction thereof, and both ends of the cable are respectively fixed to the other end of the second fixing member.

4. The earring-type microphone according to claim 1, the microphone part comprising:

a microphone body configured to have a tube shape and installed at one side of the cable; and an inputting part for inputting voice has one end thereof which is coupled to one side of the inside of the microphone body and the other end thereof which is configured to protrude outwards from the microphone body, wherein in the state in which the user are wearing the microphone part at the rear of the user's neck, when the user applies force to the inputting part at the time of inputting the voice through the inputting part, the inputting part protrudes to a certain length so as to move from the user's neck toward the area around the user's mouth.

5. The earring-type microphone according to claim 1, the earring-type microphone further comprising:

a main body configured to be a device for outputting sounds and coupled to one side of the fixing members, wherein the main body is connected to the cable so as to output sounds input by the microphone part or to send sounds played in itself or sound signals from the outside to the speakers.

6. An earring-type microphone, which is hung on a user's ear so as to be used, the earring-type microphone comprising:

two fixing members fixed to both ears of a user;

a cable connecting the two fixing members such that a part of the cable comes into close contact with the user's front jaw;

a second elastic body whose both ends are configured to be placed a certain distance apart from each other at one side of the cable so as to be respectively connected to the cable, wherein the second elastic body comes into close contact with the user's inner jaw when the cable comes into close contact with the user's front jaw;

speakers respectively coupled to both ends of the cable ; and a microphone part installed at one side of the cable for inputting voice, wherein the user's jaw is inserted into a hole formed by the cable and the second elastic body such that the cable comes into close contact with the user's front jaw and is prevented from moving by means of the elasticity of the second elastic body when the user moves the jaw.

7. The earring-type microphone according to claim 6, the fixing members comprising: first fixing members configured to have a "C" shape so as to come into close contact with rear sides of the user's pinnae; and second fixing members configured to have a "C" shape such that one end of the second fixing member is coupled to one side of the first fixing member, wherein: one end of the second fixing member contacts the outside of the user's ear, and the other end contacts the inside of the user's ear such that both ends of the second fixing member mesh with the user's ear thereby allowing the fixing member to be fixed to the user's ear, and the cable comes into close contact with the second fixing member along the length direction thereof while both ends of the cable are respectively fixed to the other end of the second fixing member.

8. The earring-type microphone according to claim 6, the earring-type microphone further comprising:

a main body configured to be a device for outputting sounds and coupled to one side of the fixing members, wherein the main body is connected to the cable so as to output sounds input by the microphone part or to send sounds played in itself or sound signals from the outside to the speakers.

9. An earring-type microphone, which is hung on a user's ear so as to be used, comprising: a fixing member fixed to one ear of a user; a cable fixed to the fixing member; a speaker coupled to one end of the cable; and a microphone part whose one end is coupled to the fixing member so as to be connected to the cable thereby inputting the user's voice, the fixing member comprising: first fixing members configured to have a "C" shape so as to come into close contact with rear sides of the user's pinnae; and second fixing members configured to have a "C" shape such that one end of the second fixing member is coupled to one side of the first fixing member, wherein one end of the second fixing member contacts the outside of the user's ear, and the other end contacts the inside of the user's ear such that both ends of the second fixing member mesh with the user's ear thereby allowing the fixing member to be fixed to the user's ear.

10. The earring-type microphone according to claim 9, the microphone part further comprising:

a third elastic body whose one end is coupled to the fixing member and the other end is coupled to the other end of the microphone part so as to wrap up the microphone part, wherein the user applies force to the microphone part at the time of inputting the voice through the microphone part so as to move the microphone part toward the area around the user's mouth, and if the force applied to the microphone part is removed, the microphone part returns to the initial state by means of the elastic force of the third elastic body.

11. The earring-type microphone according to claim 9, the earring-type microphone comprising:

a long hole made along the length direction of the first fixing member; and a microphone part whose one end moves along the long hole of the first fixing member to input voice, wherein the user applies force to the microphone part at the time of inputting the voice through the microphone part so as to move the microphone part toward the area around the user's mouth.

12. The earring-type microphone according to claim 9, the earring-type microphone comprising:

a connecting member whose one end is rotatably coupled to one side of the first fixing member; and a microphone part whose one end is coupled to the connecting member for inputting voice, wherein the user applies force to the microphone part at the time of inputting the voice through the microphone part so as to move the microphone part toward the area around the user's mouth.

13. The earring-type microphone according to claim 9, the earring-type microphone further comprising:

a main body configured to be a device for outputting sounds and coupled to one side of the fixing members, wherein the main body is connected to the cable so as to output the sounds input by the microphone part or to send sounds played in itself or sound signals from the outside to the speakers.

* * * * *